US007617573B2

(12) United States Patent
Chen

(10) Patent No.: US 7,617,573 B2
(45) Date of Patent: Nov. 17, 2009

(54) SHOELACE FASTENING ASSEMBLY

(76) Inventor: Chin-Chu Chen, No. 11, Lane 188, Gungye Road, Lung Ching Shiang, Taichung (TW)

( * ) Notice: Subject to any disclaimer, the term of this patent is extended or adjusted under 35 U.S.C. 154(b) by 398 days.

(21) Appl. No.: 11/654,521

(22) Filed: Jan. 18, 2007

(65) Prior Publication Data

US 2008/0172848 A1 Jul. 24, 2008

(51) Int. Cl.
*A43C 1/06* (2006.01)

(52) U.S. Cl. ..... 24/68 SK; 36/58.5; 36/54; 24/712.1; 24/713.9; 24/713.4; 24/712.9

(58) Field of Classification Search ..... None

See application file for complete search history.

(56) References Cited

U.S. PATENT DOCUMENTS 1,506,614 A * 8/1924 Cook ..... 24/713.4

OTHER PUBLICATIONS

US 7,516,521, 04/2009, Hammerslag (withdrawn)*

* cited by examiner

*Primary Examiner*—Jack W. Lavinder

(57) ABSTRACT

A shoelace fastening assembly includes a fastening device fixed on the tongue of a shoe and includes a main part which has a tubular member and a shoelace is wrapped on the tubular member. A knob is rotatably engaged with the main part and drives the tubular member to rotate in one direction. At least one intermediate member is fixed on the tongue and has a cruciform slot so that the shoelace is movably engaged with the cruciform slot. At least two hook members are respectively fixed on two flaps of the shoe and each hook member has an engaging groove with which the shoelace is movably engaged. The shoelace can be easily connected with the intermediate member and the hook members.

9 Claims, 8 Drawing Sheets

SHOELACE FASTENING ASSEMBLY

FIELD OF THE INVENTION

The present invention relates to a fastening assembly for shoelace which is easily to be connected with the parts of the fastening assembly.

BACKGROUND OF THE INVENTION

A conventional shoelace fastening assembly is shown in FIGS. 11 to 14 and generally includes fastening device 80 connected on the tongue 72 of the shoe 70 and the fastening device 80 includes a base 81 on which a knob 811 is rotatably mounted so as to pull or loose the shoelace 82 that is wrapped to the fastening device 80. A plurality of hook members 83 are fixed on two flaps 71 of the shoe 70 and each have a slot 831. Two holes 832 are defined through a side of the hook member 83 and communicate with the slot 831. A cover 834 is engaged with the slot 831 such that the shoelace 82 extends through the holes 832 and is limited a gap between the cover 834 and a curved inside 833 of the slot 831. A plurality of intermediate members 84 are fixed on the tongue 72 and located between the two flaps 71. Each intermediate member 84 has a cross-shaped passage 841 and the shoelace 82 coming from two hook members 83 on the two flaps 71 extends through the passage 841. The user may rotate the knob 811 to quickly loose or tighten the shoelace 82.

However, it takes a lot of time to extend the shoelace 82 through the passage 841 in each intermediate member 84 and the holes 832 of each hook member 83, and then the shoelace 82 can be wrapped to the fastening device 80. Besides, the cover 834 has to be carefully engaged with the slot 831 to position the shoelace 82 and this is a time-consuming task.

The present invention intends to provide a shoelace fastening assembly wherein each of the intermediate member and the hook member of the shoelace fastening assembly include an open access through which the shoelace can be easily engaged with.

SUMMARY OF THE INVENTION

The present invention relates to a shoelace fastening assembly which comprises a fastening device fixed on a tongue of a shoe and including a main part which has a tubular member rotatably mounted on a mandrel of the main part. A shoelace is wrapped on the tubular member. A knob is rotatably engaged with the main part and drives the tubular member in one direction so as to loosen or tighten the shoelace. At least one intermediate member is fixed on the tongue and has a cruciform slot defined in a top thereof. The shoelace is movably engaged with the cruciform slot. At least two hook members are respectively fixed on two flaps of the shoe and each of the at least two hook members has an engaging groove. The shoelace is movably engaged with the engaging grooves of the at least two hook members.

The primary object of the present invention is to provide a shoelace fastening assembly wherein the shoelace is easily engaged with the intermediate members and the hook members.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
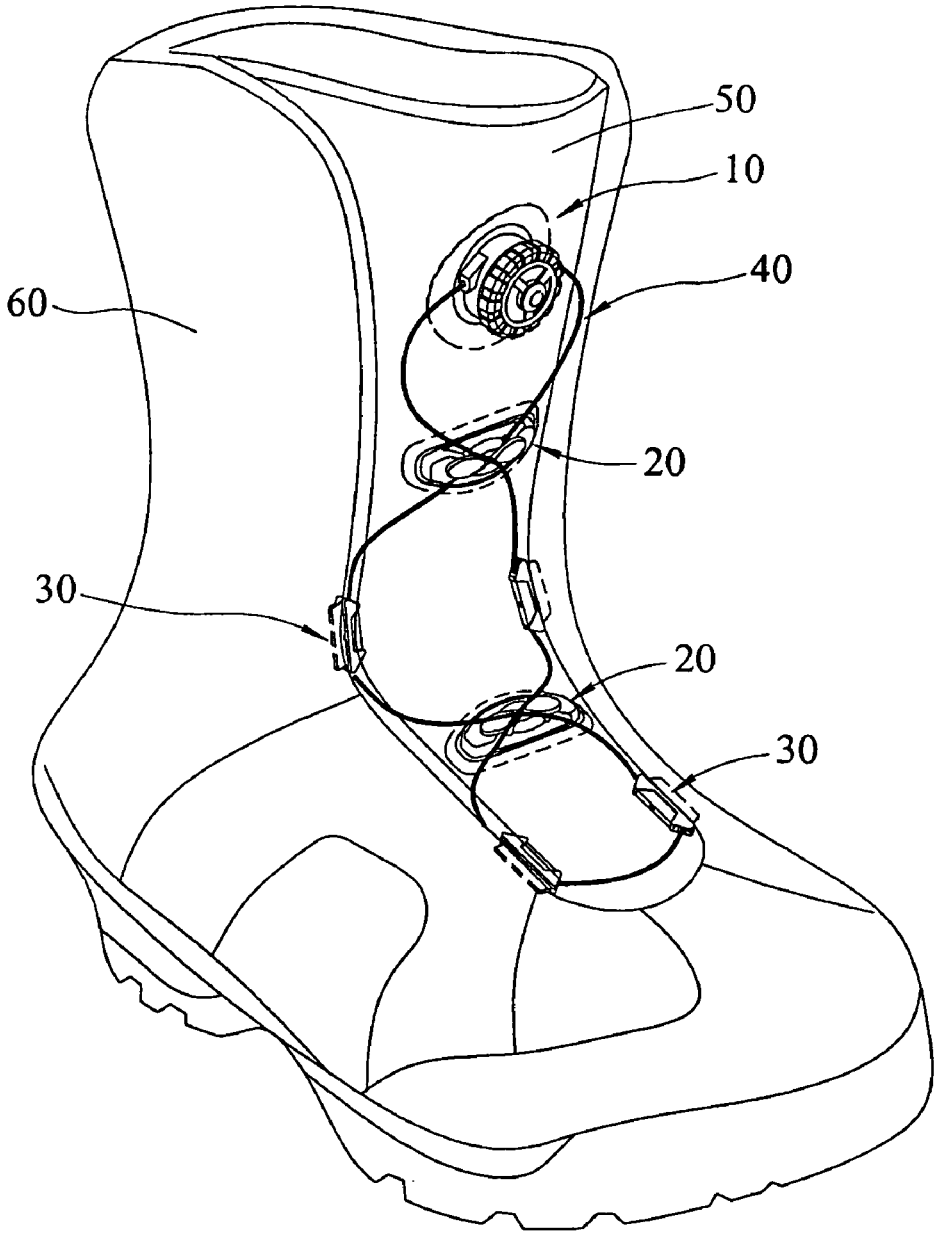
FIG. 1 shows the shoelace fastening assembly of the present invention on a shoe.
Figure 2:
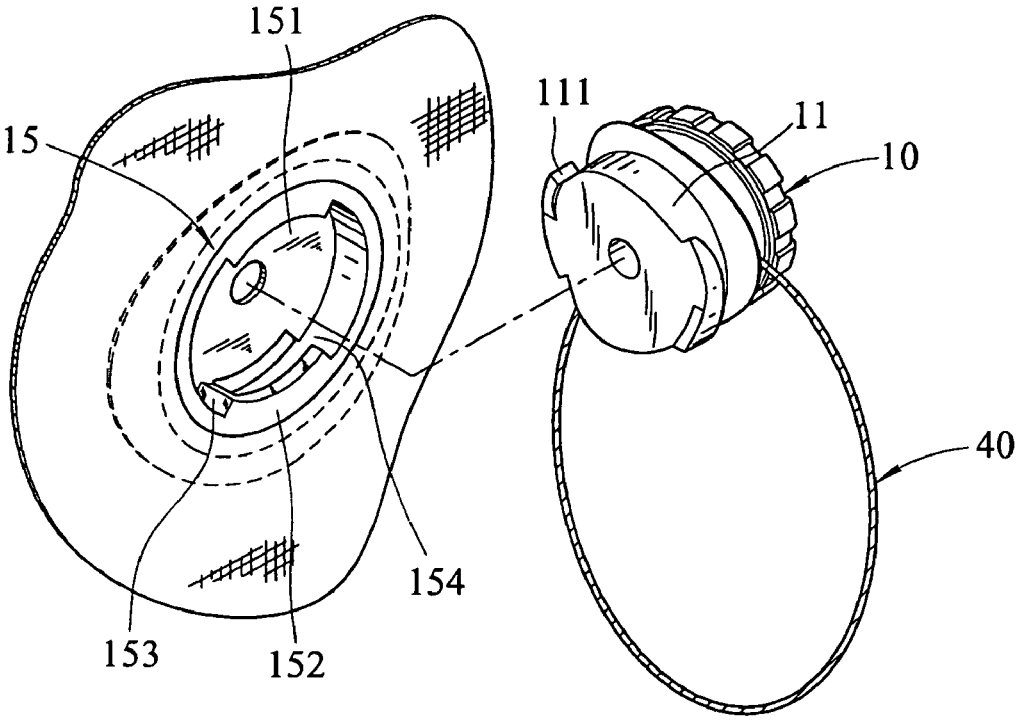
FIG. 2 is an exploded view to show the base and the main part of the fastening device of the shoelace fastening assembly of the present invention.
Figure 3:
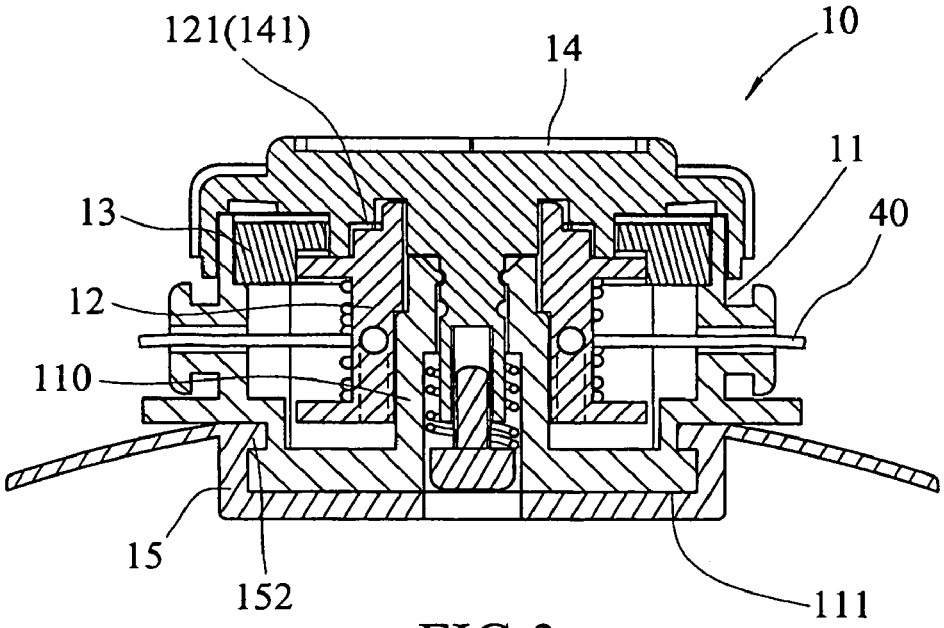
FIG. 3 is a cross sectional view to show the shoelace fastening assembly of the present invention.
Figure 4:
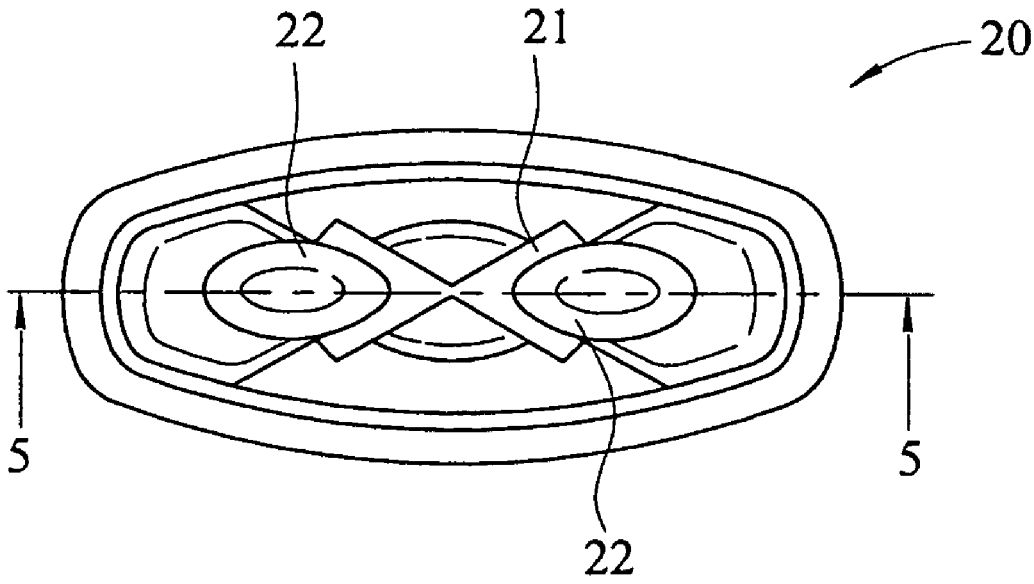
FIG. 4 shows a top view of the intermediate member of the shoelace fastening assembly of the present invention.
Figure 5:
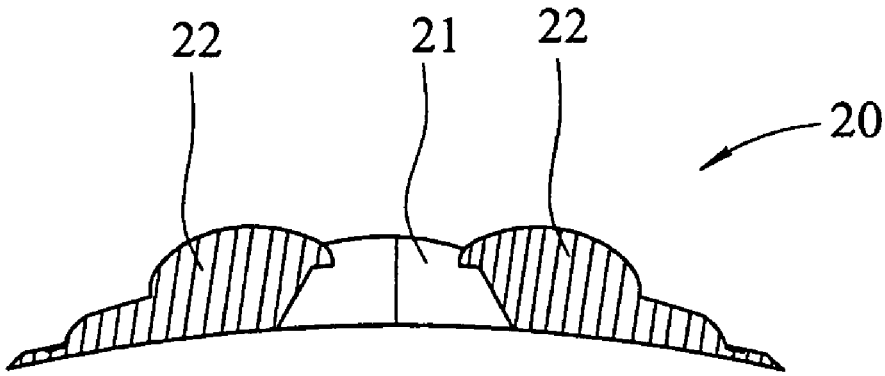
FIG. 5 is a side cross sectional view along line 5-5 in FIG. 4.

Referring to FIGS. 1 to 5, the shoelace fastening assembly of the present invention comprises a fastening device 10 fixed on a tongue 50 of a shoe and the fastening device 10 includes a base 15 fixed on the tongue 50 of the shoe, and a main part 11 which is connected to the base 15. A recess 151 is defined in the base 15 and two flanges 152 extend from an inner periphery of the recess 151 and are located diametrically opposite to each other so as to form two reception grooves 154 between the flanges 152 and an inner surface of the recess 151. The main part 11 has a tubular member 12 rotatably mounted on a mandrel 110 of the main part 11. The main part 11 has two guiding blocks 111 which are slidably engaged with the reception grooves 154 and each guiding block 111 has a thin first end and a thick second end, a smooth and spiral surface is connected between the thin first end and the thick second end. By the specific shape of the two guiding blocks 111, the main part 11 can be easily connected to the base 15 by sliding the guiding blocks 111 into the reception grooves 154. An end stop 153 is located at each of the reception grooves 154 so as to stop the guiding block 111 and prevents the guiding block 111 from overly moving in the reception groove 154.

A shoelace 40 is wrapped on the tubular member 12 and a plurality of first teeth 121 are defined in a top of the tubular member 12. A knob 14 is rotatably engaged with the main part 11 and has second teeth 141 defined in an underside thereof. The first and second teeth 121, 141 are engaged with each other so that the tubular member 12 can be rotated in one direction when rotating the knob 14.

Figure 9:
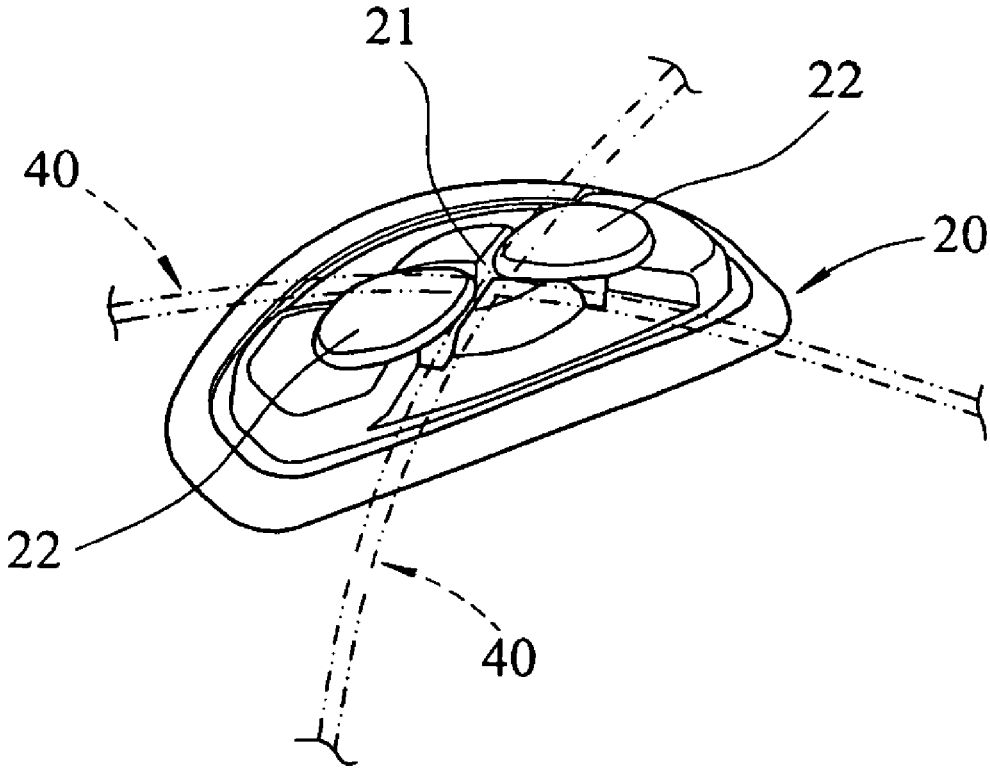
FIG. 9 shows the shoelace is engaged with the cruciform slot of the intermediate member.
Figure 10:
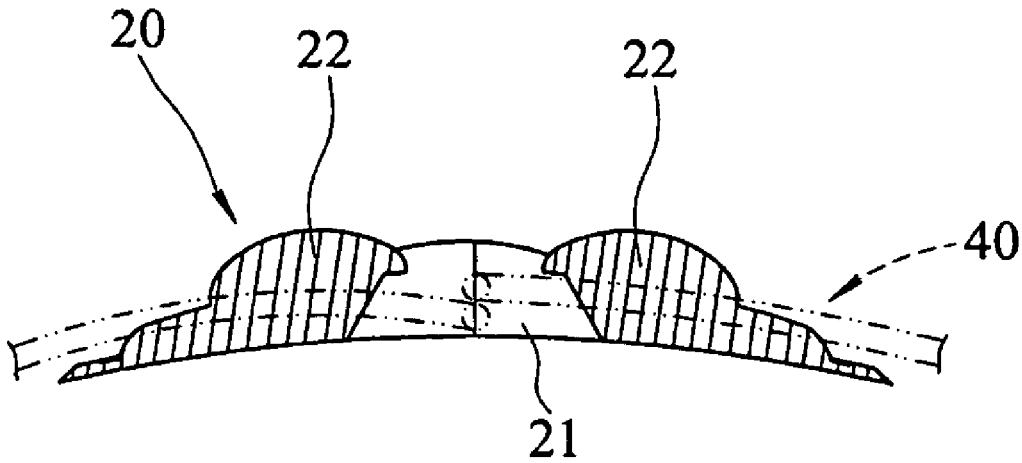
FIG. 10 shows a cross sectional view to show that the shoelace is engaged with the cruciform slot of the intermediate member.
Figure 11:
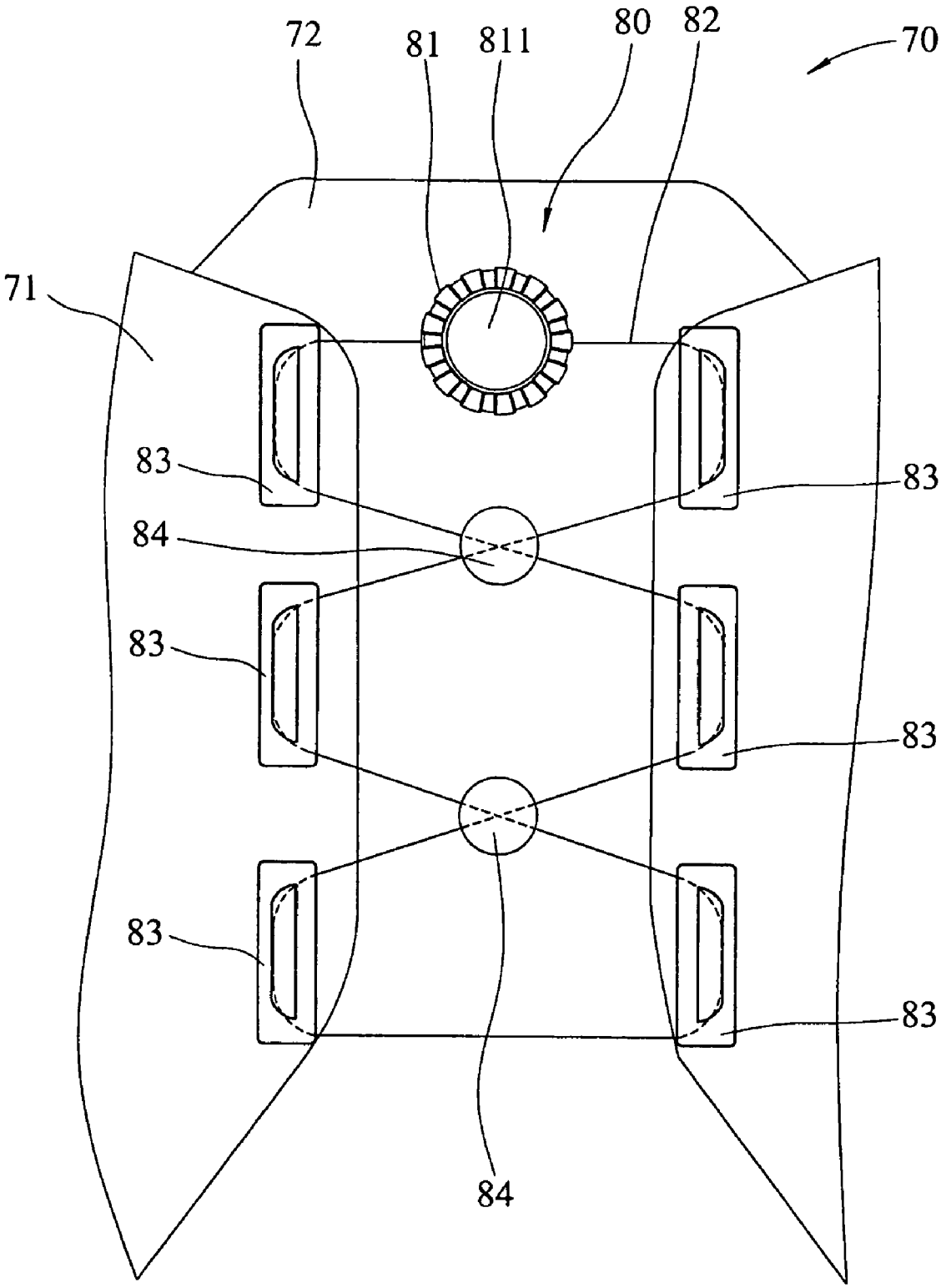
FIG.11 PRIOR ART
FIG. 11 shows a conventional shoelace fastening assembly.
Figure 12:
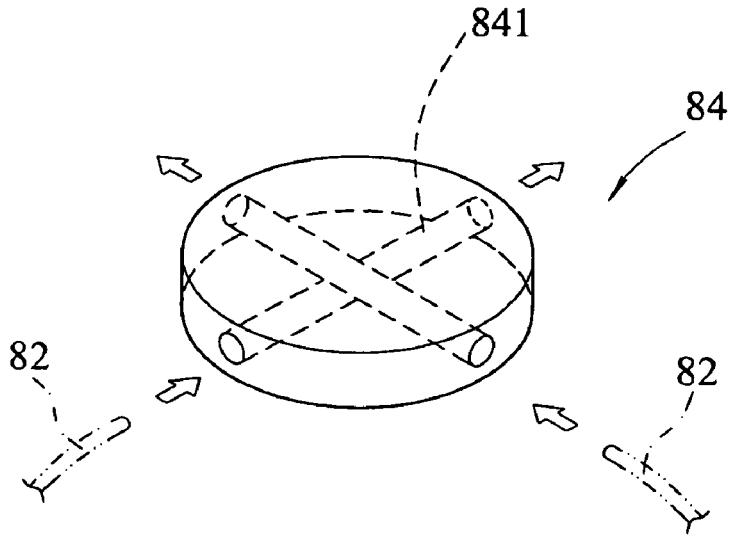
FIG.12 PRIOR ART
FIG. 12 shows the conventional intermediate member.
Figure 13:
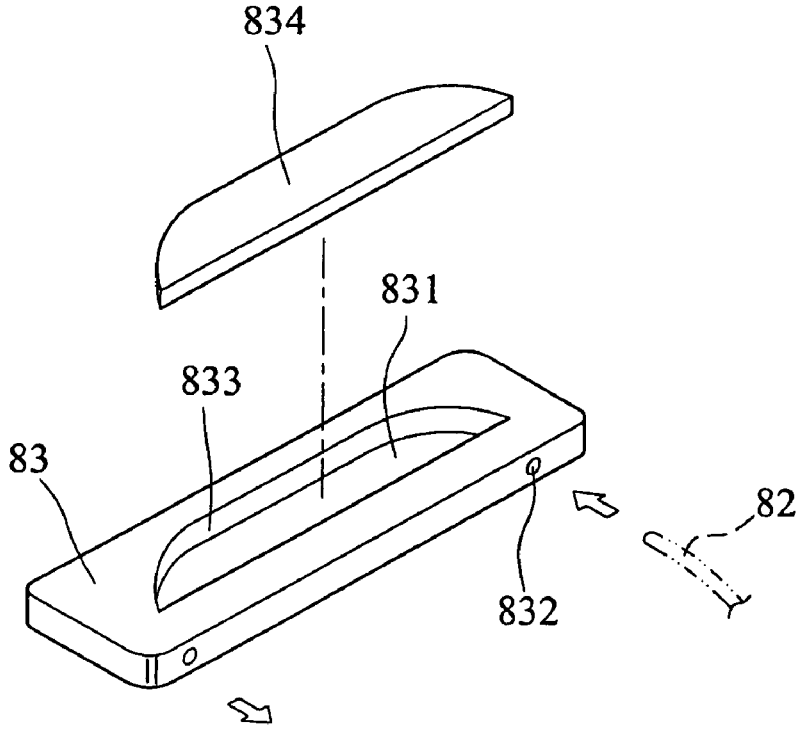
FIG.13 PRIOR ART
FIG. 13 is an exploded view to show the conventional hook member.
Figure 14:
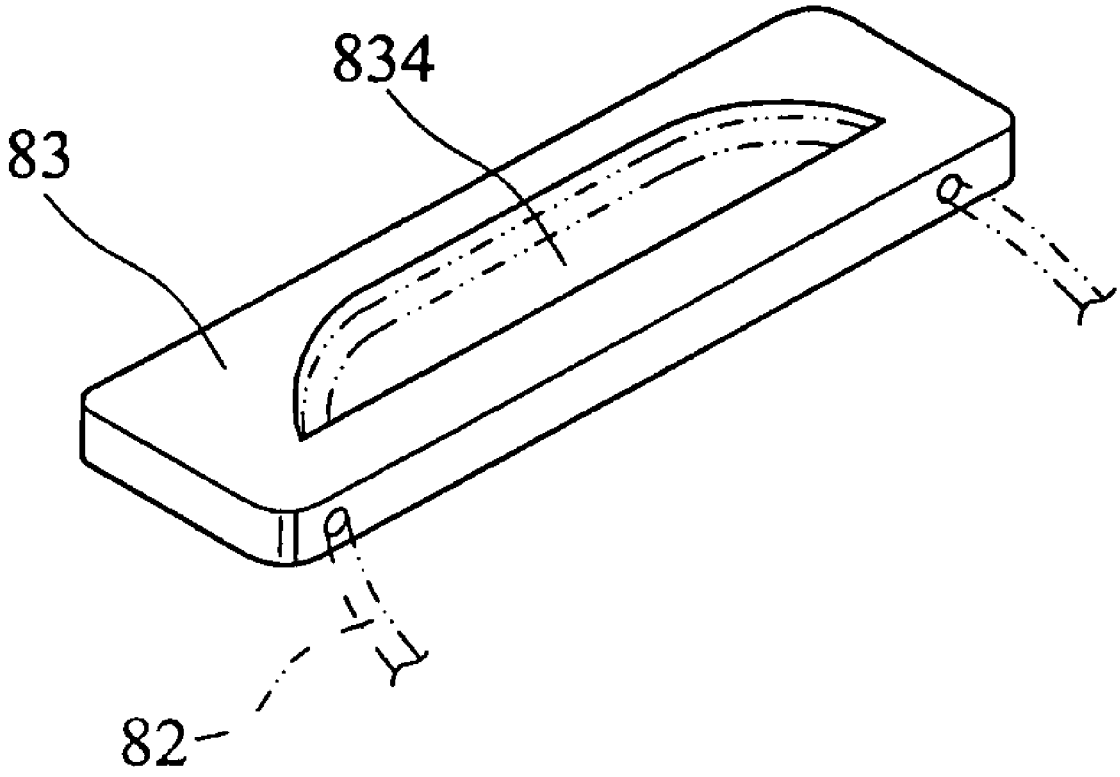
FIG.14 PRIOR ART
FIG. 14 is a perspective view to show that the shoelace is engaged with the conventional hook member

Two intermediate members 20 are fixed on the tongue 50 and each have a cruciform slot 21 defined in a top thereof. The cruciform slot 21 includes an open access via which the shoelace 40 can be movably engaged with the cruciform slot 21. The two intermediate members 20 each include a plurality of projections so as to define the cruciform slot 21. Two top flanges 22 are connected on the projections and partially cover the cruciform slot 21 so as to limit the shoelace 40 from being disengaged from the cruciform slot 21 as shown in FIGS. 9 and 10.

Figure 6:
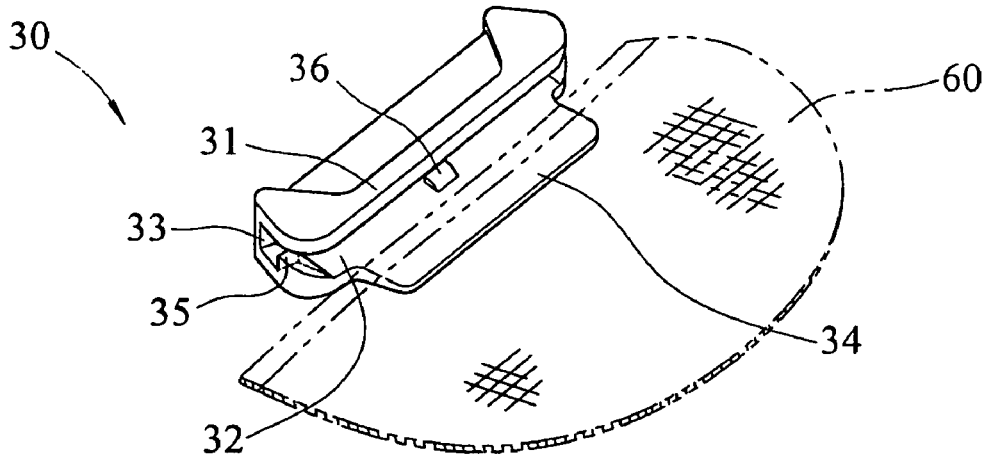
FIG. 6 shows the hook member is fixed to the flap of the shoe.
Figure 7:
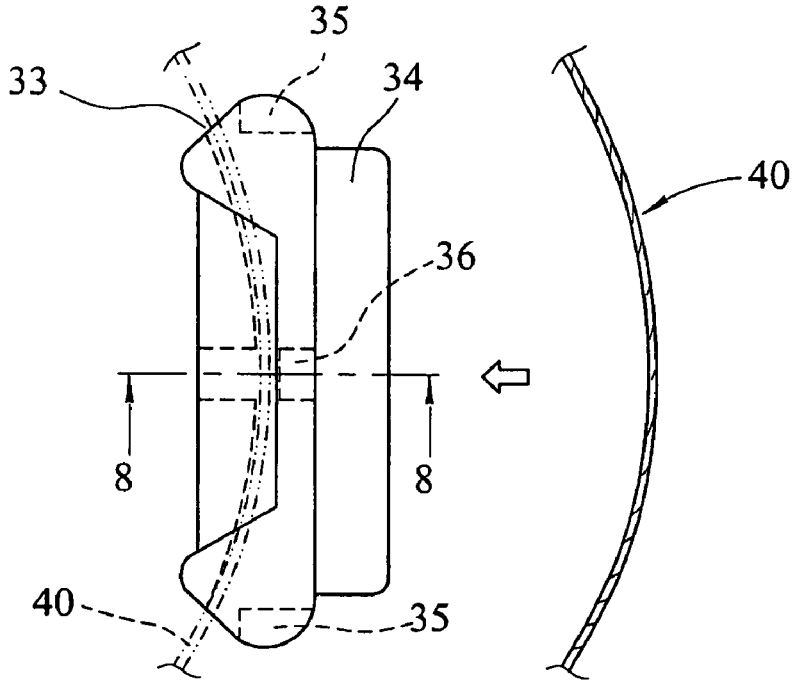
FIG. 7 shows the shoelace is to be engaged with the hook member.
Figure 8:
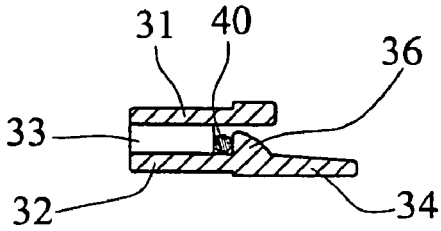
FIG. 8 is a cross sectional view along line 8-8 in FIG. 7.

As shown in FIGS. 6 to 8, two hook members 30 are fixed on each one of the two flaps 60 of the shoe and each hook member 30 includes a top part 31 and a bottom part 32. An engaging groove 33 is defined between the top and bottom parts 31, 32. The bottom part 32 has a fixing part 34 which is fixed to the flap 60. The shoelace 40 is movably engaged with the engaging grooves 33 of the hook members 30. Each of the engaging grooves 33 includes two first protrusions 35 which are located at two ends of each of the engaging grooves 33. A gap is defined between an underside of the top part 31 and each of the first protrusions 35 so that the shoelace 40 can be inserted into the engaging groove 33 via the gap. Each first protrusion 35 has a thick inner side and a thin outer side, a curved surface is connected between the thick inner side and the thin outer side. The curved surface can guide the shoelace 40 into the engaging groove 33.

A second protrusion 36 extends from a mediate portion of a top surface of the bottom part 32 and a gap is defined between the underside of the top part 31 and the second protrusion 36 so that the shoelace 40 can pass the gap to be engaged with the engaging groove 33. On the other hand, the second protrusion 36 avoids the shoelace 40 from being disengaged from the engaging groove 33. The second protrusion 36 has a thick inner side and a thin outer side, a curved surface is connected between the thick inner side and the thin outer side. The curved surface can guide the shoelace 40 into the engaging groove 33.

The shoelace fastening assembly is easily assembled and the shoelace 40 is quickly to be connected to the intermediate members 20 and the hook members 30.

While we have shown and described the embodiment in accordance with the present invention, it should be clear to those skilled in the art that further embodiments may be made without departing from the scope of the present invention.

What is claimed is:

1. A shoelace fastening assembly comprising:

a fastening device including a base which is adapted to be fixed on a tongue of a shoe and a recess defined in the base, two flanges extending from an inner periphery of the recess and located diametrically opposite to each other so as to form two reception grooves between the flanges and an inner surface of the recess, a main part having a tubular member rotatably mounted on a mandrel of the main part, the main part having two guiding blocks which are slidably engaged with the reception grooves, a shoelace wrapped on the tubular member and a plurality of first teeth defined in a top of the tubular member, a knob rotatably engaged with the main part and having second teeth defined in an underside thereof, the first and second teeth being engaged with each other, the tubular member being rotated in one direction when rotating the knob;

at least one intermediate member adapted to be fixed on the tongue and having a cruciform slot defined in a top thereof, the shoelace movably engaged with the cruciform slot, and at least two hook members which are respectively adapted to be fixed on two flaps of the shoe and each of the at least two hook members having an engaging groove, the shoelace movably engaged with the engaging grooves of the at least two hook members.

2. The assembly as claimed in claim 1, wherein each guiding block has a thin first end and a thick second end, a smooth and spiral surface is connected between the thin first end and the thick second end.

3. The assembly as claimed in claim 1, an end stop is located at each of the reception grooves so as to stop the guiding block.

4. The assembly as claimed in claim 1, wherein the at least one intermediate member includes a plurality of projections so as to define the cruciform slot, two top flanges are connected on the projections and partially cover the cruciform slot so as to limit the shoelace from being disengaged from the cruciform slot.

5. The assembly as claimed in claim 1, wherein each of the at least two hook members includes a top part and a bottom part, an engaging groove is defined between the top and bottom parts, the bottom part has a fixing part which is adapted to be fixed to the flap.

6. The assembly as claimed in claim 5, wherein each of the engaging grooves includes two first protrusions which are located at two ends of each of the engaging grooves.

7. The assembly as claimed in claim 6, wherein a gap is defined between an underside of the top part and each of the first protrusions and each first protrusion has a thick inner side and a thin outer side, a curved surface is connected between the thick inner side and the thin outer side.

8. The assembly as claimed in claim 6, wherein a second protrusion extends from a mediate portion of a top surface of the bottom part so as to avoid the shoelace from being disengaged from the engaging groove.

9. The assembly as claimed in claim 8, wherein a gap is defined between an underside of the top part and the second protrusion and the second protrusion has a thick inner side and a thin outer side, a curved surface is connected between the thick inner side and the thin outer side.

* * * * *